US009733618B2

(12) United States Patent
Mansfield et al.

(10) Patent No.: US 9,733,618 B2
(45) Date of Patent: Aug. 15, 2017

(54) TIMEPIECE WITH A SINGLE HAND FOR SIMULTANEOUSLY INDICATING BOTH HOURS AND MINUTES

(71) Applicants: Stephen Mansfield, Hong Kong (HK); Daniel Blunschi, Hong Kong (HK)

(72) Inventors: Stephen Mansfield, Hong Kong (HK); Daniel Blunschi, Hong Kong (HK)

( * ) Notice: Subject to any disclaimer, the term of this patent is extended or adjusted under 35 U.S.C. 154(b) by 0 days.

(21) Appl. No.: 14/883,774

(22) Filed: Oct. 15, 2015

(65) Prior Publication Data

US 2017/0108832 A1 Apr. 20, 2017

(51) Int. Cl.
*G04B 19/04* (2006.01)
*G04B 19/06* (2006.01)

(52) U.S. Cl.
CPC ..... *G04B 19/046* (2013.01); *G04B 19/06* (2013.01)

(58) Field of Classification Search
CPC ..... G04B 19/046; G04B 19/06
USPC ..... 368/228–238, 76, 80, 77, 223
See application file for complete search history.

(56) References Cited

U.S. PATENT DOCUMENTS 1,072,554 A 9/1913 Windsor
1,393,569 A 10/1921 Richardson
1,851,824 A 3/1932 Fewell
2,056,038 A 9/1936 De Angelis et al.
2,266,183 A 12/1941 Fergusson
2,709,331 A * 5/1955 Lehner ..... G04C 21/36 368/254
3,911,668 A 10/1975 Beguin
4,991,154 A 2/1991 Perucchi
5,134,596 A 7/1992 Harris
5,172,350 A * 12/1992 Walen ..... G04B 45/00 368/228
7,136,327 B2 11/2006 Hopkins
(Continued)

FOREIGN PATENT DOCUMENTS

CH 701830 3/2011
CH 702862 9/2011
(Continued)

OTHER PUBLICATIONS

Gyrus Watches RL SA, CH701830, "Device for Displaying a Watch Movement," English Translation, Mar. 21, 2011.
(Continued)

*Primary Examiner* — Edwin A. Leon
(74) *Attorney, Agent, or Firm* — Hanrahan Law Firm, P.A.; Benjamin M. Hanrahan

(57) ABSTRACT

A single-hand or single-indicator timepiece that can simultaneously identify both the hour and minute portion of a given time is present herein. The timepiece includes an indicator structured to rotate about the face of the timepiece and point to the hour element of the time via a distal end thereof. In addition, the same indicator includes a minute identifying portion disposed along a length thereof that will align with a rotationally disposed minute disc. The minute disc includes indicia representative of the minutes evenly spaced radially about its surface in a clockwise ascending order. As the minute disc rotates counterclockwise and the indicator rotates clockwise, the indicator will simultaneously identify the hour element at its distal end and the minute element via the relative position of the minute identifying portion and the minute disc.

17 Claims, 4 Drawing Sheets

(56) References Cited

U.S. PATENT DOCUMENTS

| | | | | |
|---|---|---|---|---|
| 8,264,911 | B2 | 9/2012 | Ferrari | |
| 8,588,033 | B2 | 11/2013 | Pozzo Di Borgo et al. | |
| 8,699,303 | B2 * | 4/2014 | Caruso ..... | G04B 19/223 368/233 |
| 2014/0340998 | A1 | 11/2014 | Funk et al. | |

FOREIGN PATENT DOCUMENTS

| | | |
|---|---|---|
| CH | 700664 | 12/2014 |
| EP | 1351105 | 10/2003 |
| EP | 2187272 | 5/2010 |
| EP | 2520985 | 11/2012 |
| EP | 2977831 | 1/2016 |
| WO | WO2010108947 | 9/2010 |
| WO | WO2011113846 | 9/2011 |
| WO | WO2011121000 | 10/2011 |
| WO | WO2016012126 | 1/2016 |

OTHER PUBLICATIONS

International Search Report for PCT/CH2016/000094, "Timepiece With a Single Hand for Simultaneously Indicating Both Hours and Minues," Mansfield, Stephen, Aug. 25, 2016.

Written Opinion of the International Searching Authority for PCT/CH2016/000094, "Timepiece With a Single Hand for Simultaneously Indicating Both Hours and Minutes," Mansfield, Stephen, Aug. 25, 2016.

Blancier Lottermann & Sohne One Glance: "Single-hand watch that tells the time to the minute," Internet Citation, Allegedly Retrieved (via the International Search Report) from the Internet at <https://www.youtube.com/watch?v=1KVdHsZ2uYI>.

* cited by examiner

TIMEPIECE WITH A SINGLE HAND FOR SIMULTANEOUSLY INDICATING BOTH HOURS AND MINUTES

FIELD OF THE INVENTION

The present invention is generally directed to a timepiece embodied in the form of a wrist watch, pocket watch, table or desk clock, wall clock or any other form of timepiece. Particularly, the timepiece includes a hand or time indicator that can be used to simultaneously identify both the hour and minute of a given time.

BACKGROUND OF THE INVENTION

A traditional watch or clock may include two separate hands, such as a minute hand and a separate hour hand, to identify the current time in hours and minutes. For example, the hour hand is traditionally smaller than the minute hand and sweeps about a watch or clock face pointing to the hours of the day. For example, in a traditional 12-hour scaled timepiece, the hour hand will complete two (2) full 360° rotations in a full 24 hour day, and in a 24-hour scaled timepiece, the hour hand will complete one (1) full 360° rotation in a full 24 hour day. The minute hand will traditionally sweep around the face of the watch or clock at a rate of exactly one revolution (or) 360° per hour and will rotationally point to portions of the watch or clock face to identify the current minute. Thus, in order to identify the current time, a user will separately locate the position of the hour hand and the position of the minute hand, and based thereupon, determine the time.

The proposed timepiece presented herein will feature a single hand or time indicator that can be used to simultaneously identify both the hour element and the minute element of the current (or other) time traditionally presented with 12 or 24 hour scales and a 60 minute scale over the 360° face. The single hand will rotate about the face of the timepiece in a similar manner as a traditional hour hand, e.g., in a 12-hour scaled timepiece, the single hand of the proposed invention will complete two (2) full 360° rotations in a full 24 hour day, and in a 24-hour scaled timepiece, the hour hand will complete one (1) full 360° rotation in a full 24 hour day. Advantageously, a rotational minute panel or disc will move at an appropriate speed or rate such that indicia disposed thereon will cooperatively align with the single hand or indicator, such as the hour hand, to precisely identify the current minute element. The outer distal end of the hand will point to or otherwise identify the hour element or portion of the time, for example, based upon fixed or static hour indicia.

Accordingly, the proposed timepiece features a unique manner in which the hours and minutes are identified by a single hand, e.g., rotating around the face of the timepiece at the speed of an hour hand, offering an easy and precise way to read or determine the time while still remaining in the context of a classic and elegant timepiece, e.g., with a traditional hours and minutes scale.

SUMMARY OF THE INVENTION

The various embodiment of the present invention are directed to a single-hand or single-indicator timepiece that can simultaneously identify both the hour and minute portion of a given time. For instance, the single hand of various embodiments of the present invention will rotate about a face of the timepiece at a rate and in a direction (e.g., clockwise) similar to an hour hand. Specifically, in a 12-hour scaled timepiece (i.e., 12 hours indicated around the face of the timepiece), the single hand will complete two (2) full 360° rotations in a full 24 hour day. In a 24-hour scaled timepiece, the single hand will complete one (1) full 360° rotation in a full 24 hour day. As provided herein, a minute disc may also rotate about the face of the timepiece in a manner such that the single (hour) hand will align with minute indicators to simultaneously identify both the hour and the minute. Other additional indicators may be included on the timepiece within the spirit and scope of the present invention to identify elements other than the hour and minute, such as a second hand indicator, date (month, day, or year) indicator, chronograph, moon phase indicator, etc.

For instance, the (hour) hand or time indicator includes an outer distal end that will sweep about the face of a watch or clock and point to or otherwise identify the hour element of the time. Specifically, in some embodiments, the face of the watch or clock may have hour indicia (e.g., numerical or other indicia) fixedly or statically disposed about the periphery thereof. In this manner, as the hand or indicator rotates about the face of the timepiece in a clockwise direction, the outer distal end of the hand will consecutively point to the statically disposed hour indicia to identify the hour element of the time. Of course, some embodiments may include lines, dots, dashes, or other non-numerical indicia for the hour indicia, whereas other embodiments may not include any hour indicia. In this manner, a user may be able to identify the hour element of the time based upon the relative position of the hand or indicator on the face of the timepiece, for example, based upon a traditional 12-hour clock or watch face. Other scaling of the hour indicia are contemplated with the scope of the present invention.

In addition, the same (hour) hand or indicator of at least one embodiment includes a minute identifying portion, for example, that may be disposed along a length of the hand or time indicator between the outer distal end and an inner proximal end thereof. The minute identifying portion of the hand or indicator will align with a rotationally disposed minute disc or panel that includes indicia disposed thereon representative of the minutes. For instance, the minute disc may include indicia evenly spaced radially about its surface that represent sixty minutes in an hour. In this manner, there may be sixty (60) indicia elements (whether numerical indicia or non-numerical graphics, such as lines, dashes, dots, indents, protrusions, etc.) evenly spaced on the minute disc. Other scaling of the minute indicia are contemplated within the scope of the present invention.

In some embodiments, the minute disc will rotate in a counterclockwise direction or opposite the clockwise direction of the hand or indicator. The minute indicia disposed on the minute disc may be disposed in a clockwise ascending order, meaning that if you start at the indicia representative of one (1), for example, and move in a clockwise direction, the representative numbers in at least one embodiment will increase from one (1) to fifty-nine (59) or sixty (60), whether numerical or representative of a number.

Furthermore, in certain embodiments of the present invention, the minute disc or panel will rotate slightly less than one full or complete revolution per hour, which is less than the rate of a traditional minute hand. For instance, the minute disc or panel of one embodiment will rotate at a rate calculated by the following: ((number of hours represented on face)−1)/(number of hours represented on face) per hour. Thus, if the number of hours represented on the face of the timepiece is twelve (12), the hand or indicator will rotate clockwise relative to the face at a rate of 30° per hour (or two full revolutions in a twenty-four hour period), and the minute disc or panel will rotate counterclockwise at a speed or rate of 11/12ths of a full revolution per hour. Moreover, if the number of hours represented on the face of the timepiece is twenty-four (24), the hand or indicator will rotate clockwise relative to the face at a rate of 15° per hour (or one full revolution in a twenty-four hour period), and the minute disc or panel will rotate counterclockwise at a speed or rate of 23/24ths of a full revolution per hour.

In certain embodiments, the minute identifying portion of the hand or indicator may include a magnification element, window, display opening, etc. that will identify one or more minute indicia disposed on the rotating minute disc to identify the minute element of the time.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
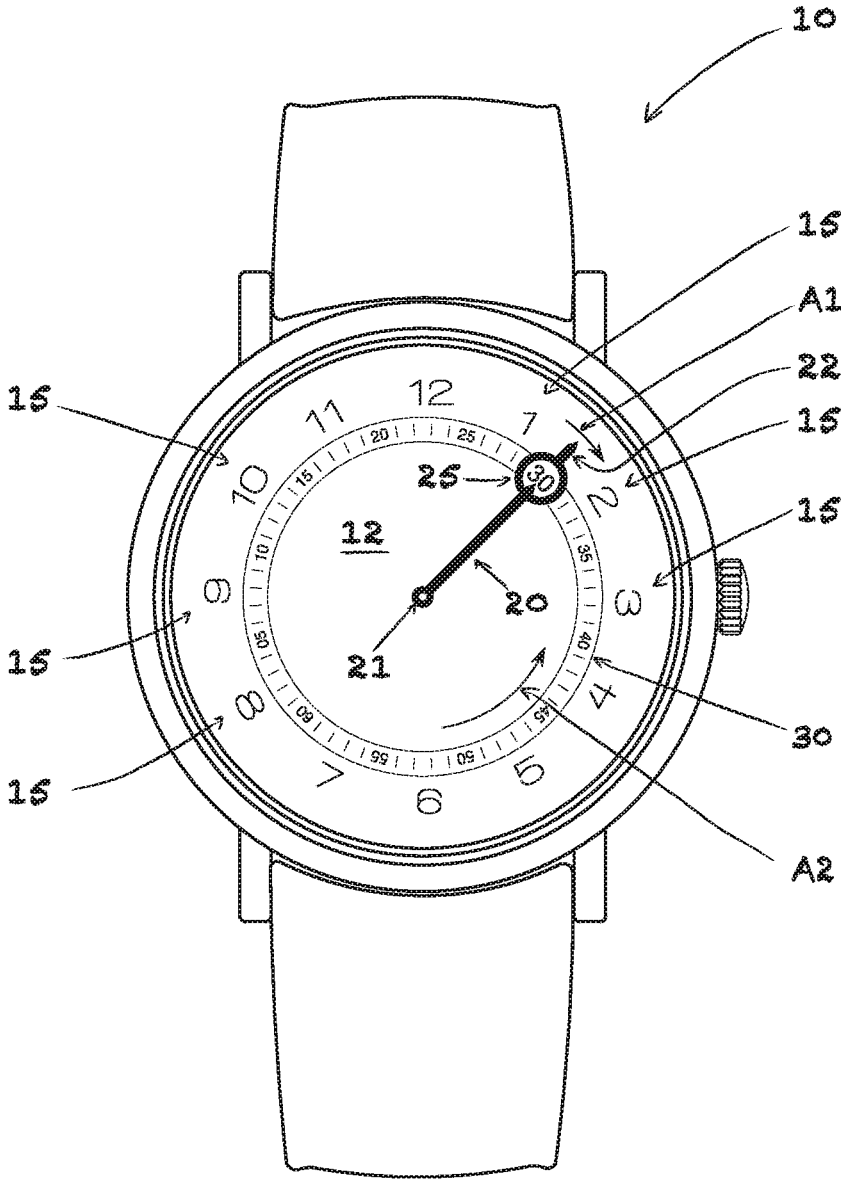
FIG. 1 is a schematic representation of the timepiece as disclosed in accordance with at least one embodiment of the present invention, illustrating an exemplary time of 1:30.

As shown in the accompanying drawings, and with particular reference to FIG. 1, for example, the present invention is directed to a timepiece, generally referenced as 10, with a time indicator 20 for simultaneously indicating an hour element and a minute element of a current time. It should be noted that the various embodiments of the timepiece 10 of the present invention may be embodied within a wrist watch (as illustrated in exemplary FIGS. 1 through 4), a pocket watch, table or desk clock, wall clock, or virtually any mechanism structured to display or track the time. It should also be noted that the various mechanisms, hardware, gears or driving assemblies used to implement the timepiece 10 of the present invention, including movement of certain features including the time indicator 20 and a minute panel or disc 30, as described herein, may be analog, digital or a combination of both analog and digital.

Specifically, with reference to FIG. 1, at least one embodiment of the present invention includes a single time indicator 20, including but not limited to an elongated hand or pointer, that is used to simultaneously indicate both the hour and the minute of the time. For example, the indicator 20 may rotate, sweep or move about a face 12 in a clockwise direction, as indicated by arrow A1. For instance, the single hand or time indicator 20 of various embodiments of the present invention will rotate about a face of the timepiece 10 at a rate and in a direction (e.g., a clockwise direction) similar to an hour hand of a traditional timepiece. Specifically, in a 12-hour scaled timepiece (i.e., the timepiece indicates 12 hours disposed 360° around the face 12, as in FIGS. 1 and 2), the single hand or time indicator 20 will complete two (2) full 360° rotations in a full 24 hour day. In a 24-hour scaled timepiece (i.e., the timepiece indicates 24 hours disposed 360° around the face 12, as in FIGS. 3 and 4), the single hand or time indicator 20 will complete one (1) full 360° rotation in a full 24 hour day. It should be noted that the watch or clock face 12 of the various embodiments may be configured in virtually any shape, size or form and includes a surface upon which the indicator 20 moves or rotates in order to indicate the time, as described herein.

For instance, in certain embodiments, the present invention may include one or more indicia 15 that represent the hour elements of the time disposed in a pre-scaled manner about the face 12 of the timepiece 10. For instance, in the embodiment shown in FIGS. 1 and 2, the hour indicia 15 comprise numerical indicia from one (1) to twelve (12) evenly or otherwise spaced radially about the face 12, for example, at or near an outer peripheral edge of the face 12. In such an implementation, the indicator 20 will sweep or rotate about the face 12 at a rate of two (2) times per twenty-four (24) hours, or at a rate of approximately thirty degrees (30°) per hour. Other rates or speeds may be contemplated, for example, based upon different hour indicia 15 or different shapes of the face 12 or timepiece 10. Other scaling of the hour indicia 15 may also be contemplated.

Figure 2:
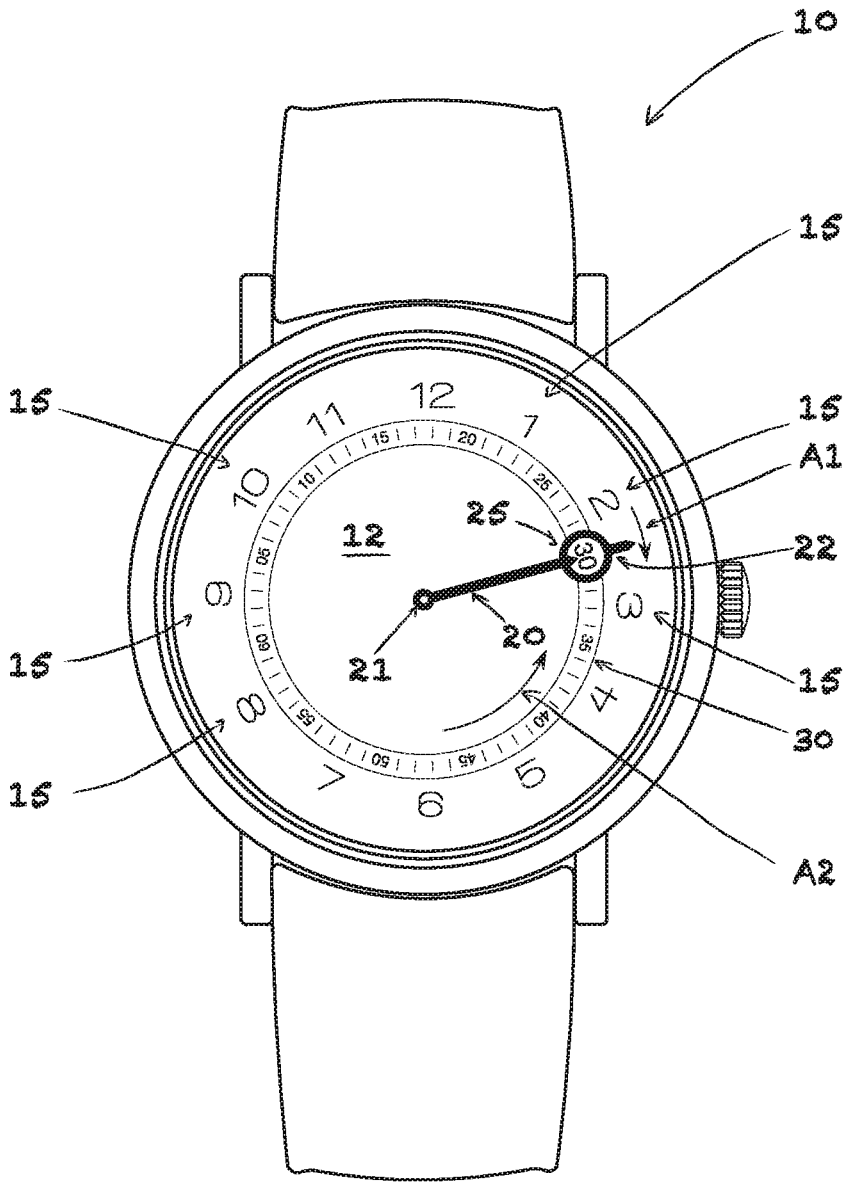
FIG. 2 is another schematic representation of the timepiece illustrated in FIG. 1, illustrating an exemplary time of 2:30.

It should also be noted that, although FIGS. 1 and 2 illustrate all of the numerical indicia 15 from one (1) to twelve (12), the hour indicia 15 may include one or more hash marks, dots, or other marks instead of or in addition to numerical indicia. For example, the hour indicia 15 may include numbers twelve (12), three (3), six (6) and nine (9), whereas the other numbers (e.g., one, two, four, five, seven, eight, ten and eleven) may be replaced with hashes, dots, lines, or other marks. Of course, the hour indicia 15 of other embodiments may include all marks (and no numerical indicia) or any combination of marks and numerical indicia. Still, other embodiments may not include any hour indicia. In such an embodiment, the hour element of the time may be determined based upon the relative position of the indicator 20, and in particular, the outer distal end 22 thereof, on the face 12 or timepiece 10.

Figure 3:
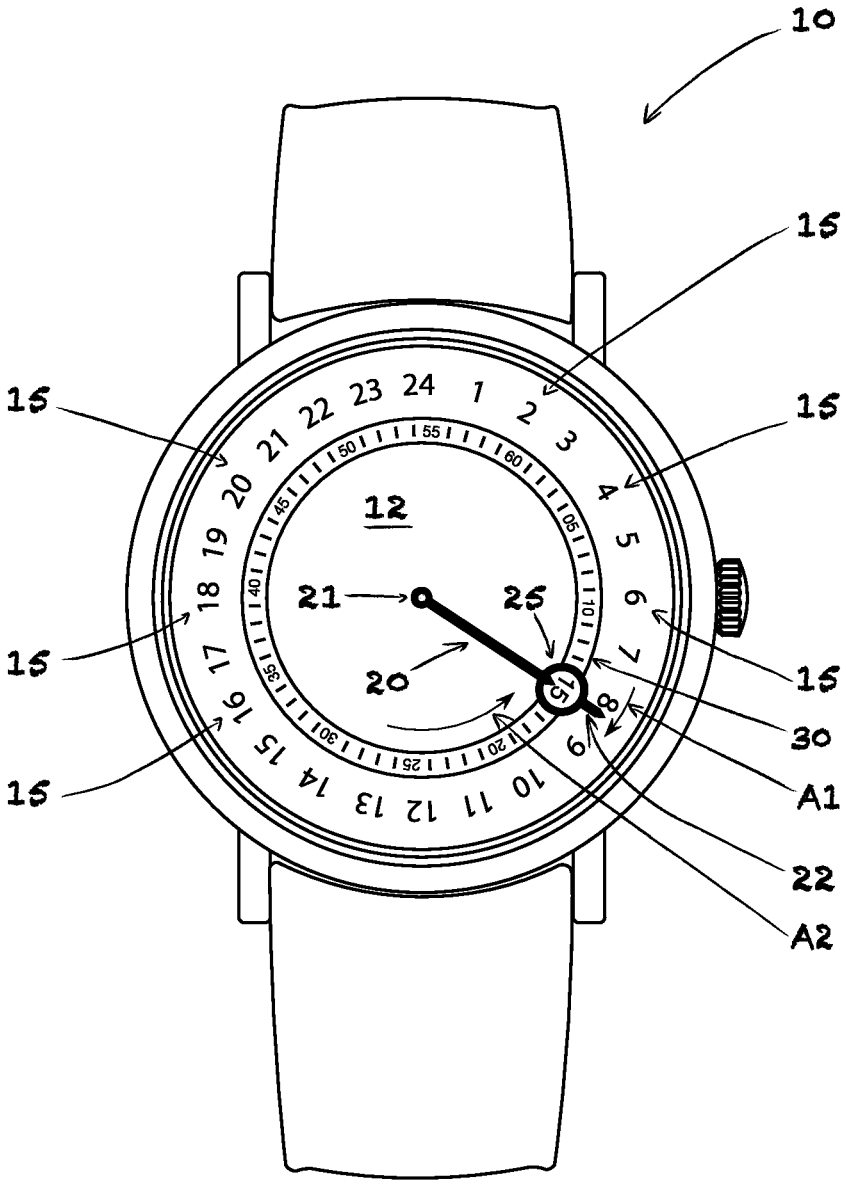
FIG. 3 is a schematic representation of the timepiece as disclosed in accordance with another embodiment of the present invention, illustrating and exemplary time of 8:15.
Figure 4:
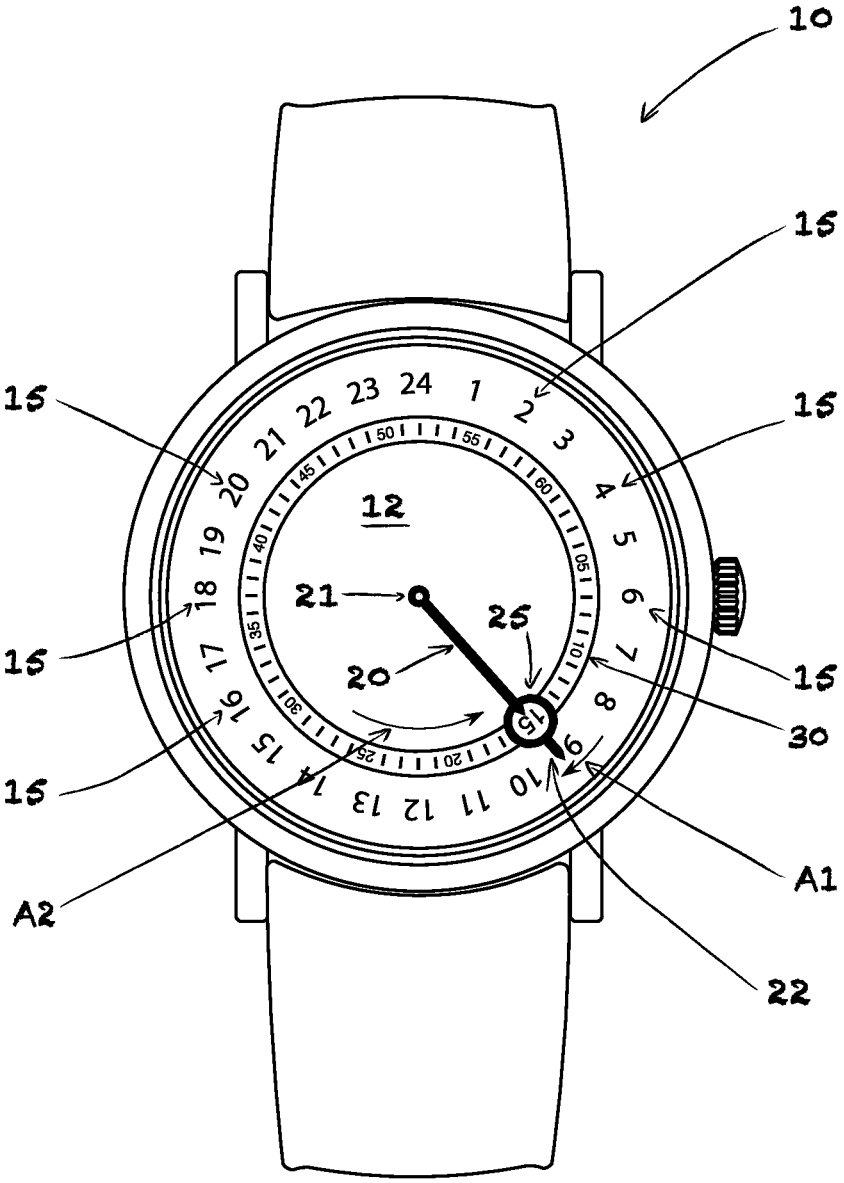
FIG. 4 is another schematic representation of the timepiece illustrated in FIG. 1, illustrating an exemplary time of 9:15.

Other embodiments, such as that illustrated in FIGS. 3 and 4, may include a timepiece 10 wherein the indicator 20 is configured to sweep or rotate about the face 12 one (1) time per twenty-four (24) hours. For example, the hour indicia 15 of such an embodiment may include numerical indicia from one (1) to twenty-four (24) evenly or otherwise spaced radially about the face 12. In such an implementation, the indicator 20 will sweep or rotate about the face 12 at a rate of approximately fifteen degrees (15°) per hour. Of course, similar to the embodiment of FIGS. 1 and 2, the hour indicia 15 may include any combination of numerical indicia or other marks representing the hour elements of the time.

Furthermore, in certain embodiments, the hour indicia 12 are fixedly or statically disposed on the face 12 or relative to the face 12 such that their position on the timepiece 10 is relatively static. In this manner, as the indicator 20 sweeps or rotates about the face 12 in a clockwise manner, as shown by arrow A1, the indicator 20 will consecutively indicate the hour element of the time based upon the relative position of the indicator 20 and the hour indicia 15. In certain embodiments, the outer or distal end 22 of the indicator 20 is used to indicate the hour element of the time, for example, by pointing to a position on the face 12 relative to the hour indicia 15. Of course, as described above, certain embodiments may not include any hour indicia such that the hour element is determined based upon the location of the indicator 20 relative to or on the face 12.

Moreover, at least one embodiment of the present invention further includes a minute panel, plate, ring, dial or disc, generally represented as 30, which rotates or moves, for example, relative to the face 12 and/or indicator 20. As shown in FIGS. 1 through 4, the minute panel or disc 30 comprises a plurality of indicia disposed thereon which are representative of the minute elements of the time, and thus, in certain embodiments, represent numbers one (1) through sixty (60) (or zero through fifty nine) either in the form of numerical indicia and/or other graphic scaling elements or marks, such as hash or dash marks, lines, dots, triangles, squares, etc. For example, in the exemplary embodiment shown in FIGS. 1 through 4, every fifth minute indicia is a numerical indicia, whereas the remaining indicia are graphic lines. This numerical and graphical combination of minute indicia should not be deemed limiting in that virtually any indicia representing the minute elements may be contemplated within the full spirit and scope of the present invention.

Furthermore, the minute panel or disc 30 of one embodiment may be disposed or positioned within the face 12 such that the minute panel or disc 30 is at least partially recessed below, but visible through, the face 12. However, in some embodiments, the minute panel or disc 30 may be at least partially flush with the surface of the face 12, and in other embodiments, the minute panel or disc 30 may extend outward or beyond the surface of the face 12. In any event, the minute panel or disc 30 is structured to rotate, for example, relative to the face 12 and/or relative to the indicator 20, in order to correspondingly position the minute indicia disposed thereon relative to the indicator 20 to represent or indicate a current minute element of the time. For example, the indicator 20 is structured to identify or indicate the minute element based upon the location of the indicator 20 relative to the minute panel or disc 30, and in particular, relative to the minute indicia disposed on the minute panel or disc 30.

Particularly, in some embodiments, the indicator 20 includes a minute identifying portion 25 that is aligned with or otherwise positioned to correspondingly point to, highlight, or indicate a minute indicia or position on the minute panel or disc 30 in order to identify the minute element of the time. For example, in one embodiment the minute identifying portion 25 may be disposed along the length of the indicator 20 or hand such as between the outer distal end 22 and an inner proximal end 21. Particularly, the outer distal end 22 of the indicator 20 may be used to identify or indicate the hour element, as described above, and in some embodiments, the inner proximal end 21 may define a pivot point or axis about which the indicator 20 rotates or moves. In this regard, the minute panel or disc 30 may be disposed radially within or on the inside (e.g., concentrically) of the hour indicia 15, or otherwise of the portion of the face 12 that represents the hour elements of the time. This allows the outer distal end 22 of the indicator to point to or identify the hour element, and the minute identifying portion 25 (being disposed interiorly of the distal end 22) to identify the minute element of the time.

In any event, the minute identifying portion 25 of the indicator 20 is structured to align with the minute panel or disc 30 in a manner such that the minute identifying portion 25 will identify one or more minute indicia to define the minute element of the time. For instance, as the minute panel or disc 30 and the indicator 20 rotate in their relative directions, the minute indicia disposed on the minute panel or disc 30 are consecutively disposed in an at least partially aligned relation with the minute identifying portion 25 in order to consecutively identify the minute element of the time. In at least one embodiment, for example, as shown in FIGS. 1 and 2, the minute identifying portion 25 includes an opening or window through which the minute indicia will be displayed. In some embodiments the minute identifying portion 25 may further include a magnifying element within the window, for example, in order to magnify or increase the visible size of the corresponding minute indicia aligned therewith.

A pointer, arrow, line or other marking may also be included within or as part of the minute identifying portion 25 in order to further facilitate the identification of the corresponding minute indicia to define the minute element of the time. It should also be noted that in some embodiments the minute identifying portion 25 may simply include a section of the indicator 20 that aligns with the minute panel or disc 30. For example, although not shown in drawings, the indicator 20 may include a substantially straight configuration from the distal end 22 to the proximal end 21, and the section of the indicator 20 that overlies or otherwise aligns with the minute panel or disc 30 may be defined as the minute identifying portion 25 of the indicator.

Still referring to the embodiment of FIGS. 1 and 2, the minute panel or disc 30 may be structured to rotate in a counterclockwise manner relative to the face 12, for example, as referenced by arrow A2. Accordingly, since the indicator 20 of one embodiment rotates or sweeps about the face 12 in a clockwise manner, referenced by A1, the minute panel or disc 30 of at least one embodiment is structured to rotate in an opposite direction as the indicator 20. Thus, the minute indicia disposed on the minute panel or disc 30 in such an embodiment are configured in a clockwise ascending order, for example, representing numbers one (1) through sixty (60), zero (0) through fifty-nine (59), or other scaling. For instance, looking at the face 12 of the timepiece 10 of one embodiment, the minute indicia disposed on the minute panel or disc 30 will increase in a clockwise manner, while the minute panel or disc 30 rotates in a counterclockwise manner. Thus, as the indicator 20 moves in the clockwise manner about the face 12, the minute identifying portion 25 thereof will correspondingly align with the minute panel or disc 30 in order to point to, highlight, or otherwise identify the minute element, e.g., through the display window or other portion.

Furthermore, and still referring to the exemplary embodiment of FIGS. 1 and 2, the minute panel or disc 30 is structured to rotate at a speed less than the speed or rate of a traditional minute hand. For example, a traditional minute hand will rotate one complete revolution per hour as the minutes progress from one to fifty nine or sixty.

Specifically, in at least one embodiment of the present invention, the minute panel or disc 30 will rotate at a speed or rate of slightly less than one full revolution per hour, and in particular, the minute panel or disc 30 of one embodiment will rotate at a speed or rate of ((number of hours represented on face)−1)/(number of hours represented on face) per hour. Thus, in the embodiment illustrated in FIGS. 1 and 2, wherein the number of hours represented on the face 12 of the timepiece is twelve (12), the minute panel or disc 30 will rotate at a speed or rate of $^{11}/_{12}$ths of a full revolution per hour.

As an example, the time indicated by the timepiece 10 in FIG. 1 is 1:30, in that the indicator 20, and in particular the distal end 22 thereof, is pointing or positioned between the hour indicia 15 representing one (1) and two (2), and the minute identifying portion 25 of the same indicator 20 is aligned with the minute indicia of the minute panel or disc 30 representing thirty (30). FIG. 2 represents the same timepiece 10 one hour later, for example, at 2:30, in that the indicator 20, and in particular the distal end 22 thereof, is pointing or positioned between the hour indicia 15 representing two (2) and three (3), and the minute identifying portion 25 of the same indicator 20 is again aligned with the minute indicia of the minute panel or disc 30 representing thirty (30). Because the minute panel or disc 30 in this example rotates in a counterclockwise direction, as represented by arrow A2, the minute panel or disc 30 has moved or rotated less than a full revolution, and specifically, 11/12ths of a full revolution between FIGS. 1 and 2.

FIGS. 3 and 4 represent another embodiment of the present invention wherein the face 12 of the timepiece 10, and in particular, the hour indicia 15 thereof, comprises an indication or representation of twenty-four (24) hours in that the indicator 20 will rotate or sweep on full complete revolution per every twenty-four (24) hours. Also, similar to the embodiment illustrated in FIGS. 1 and 2, the minute panel or disc 30 rotates in a counterclockwise direction indicated by arrow A2, which is opposite to the clockwise direction of the indicator 20, as shown by arrow A1. Furthermore, in this embodiment, the minute panel or disc 30 will rotate at a speed or rate of less than one full revolution per hour, and in particular, at a speed or rate of ((number of hours represented on face)−1)/(number of hours represented on face) per hour. Thus, in the embodiment illustrated in FIGS. 3 and 4, wherein the number of hours represented on the face 12 of the timepiece is twenty-four (24), the minute panel or disc 30 will rotate at a speed or rate of 23/24ths of a full revolution per hour.

For example, the time indicated by the timepiece 10 in FIG. 3 is 8:15, in that the indicator 20, and in particular the distal end 22 thereof, is pointing or positioned between the hour indicia 15 representing eight (8) and nine (9), and the minute identifying portion 25 of the same indicator 20 is aligned with the minute indicia of the minute panel or disc 30 representing fifteen (15). FIG. 4 represents the same timepiece 10 one hour later, for example, at 9:15, in that the indicator 20, and in particular the distal end 22 thereof, is pointing or positioned between the hour indicia 15 representing nine (9) and ten (10), and the minute identifying portion 25 of the same indicator 20 is again aligned with the minute indicia of the minute panel or disc 30 representing fifteen (15). Because the minute panel or disc 30 in this example rotates in a counterclockwise direction, as represented by arrow A2, the minute panel or disc 30 has moved or rotated less than a full revolution, and specifically, 23/24ths of a full revolution between FIGS. 3 and 4.

Furthermore, the timepiece 10 of the various embodiments of the present invention may include a plurality of gearing mechanisms or driving mechanisms (not shown) in order to implement the rotational movement of the minute panel or disc 30 and/or indicator 20. In addition, it should be noted that the various features of the present invention, including the minute panel or disc 30, the indicator 20, and/or any additional indicators, components or elements may be implemented in an analog and/or digital manner. For example, the indicator 20 may include an analog needle or pointer in some embodiments, although other embodiments may include virtually any time indicator within the scope of the present invention, including, but not limited to any kind of motive display such as a rotating transparent (or other) disc, pointer, or indicator. Similarly, the minute panel or disc 30 may include virtually any analog or digital display, disc, ring, dial, panel, plate, etc. structured and configured to rotate or change in the manner described herein so as to allow the time (hour element and minute element) to be identified by the single indicator 20.

Moreover, other or additional indicators may be incorporated within the timepiece 10 of the various embodiments of the present invention and still fall within the full spirit and scope described herein. For example, additional indicators may include, but are in no way limited to a second hand or second time element indicator, a display or indication of the date, date, month, year, a display or indicator for a second or different time zone, a chronograph, a display or indicator or moon phases, etc.

In other embodiments of the present invention, although not illustrated, it is contemplated that the minute panel or disc 30 may rotate or otherwise move in a clockwise relation about the face 12 of the timepiece 10. For instance, the minute panel or disc 30 may rotate or move about the face 12 in the same direction as the indicator 20. In such an embodiment, the indicator 20 will still identify both the hour element and the minute element of the time in a similar manner as described above with reference to FIGS. 1 through 4, although the minute panel or disc 30 will include minute indicia disposed in an ascending counterclockwise order, and the minute panel or disc 30 will rotate or move in at a different rate or speed than that provided in the embodiments of FIGS. 1 through 4.

For instance, in such an embodiment, the minute panel or disc 30 (with counterclockwise ascending indicia) may rotate clockwise at a speed or rate of slightly greater than one full revolution per hour, and in particular, the minute panel or disc 30 may rotate clockwise at a speed or rate of ((number of hours represented on face)+1)/(number of hours represented on face) per hour. Thus, as an example, if the number of hours represented on the face 12 of the timepiece is twelve (12), a clockwise rotational minute panel or disc 30 will rotate at a speed or rate of 13/12ths of a full revolution per hour. Similarly, if the number of hours represented on the face 12 of the timepiece is twenty-four (24), a clockwise rotational minute panel or disc 30 will rotate at a speed or rate of 25/24ths of a full revolution per hour.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A timepiece, comprising:

a single indicator rotationally movable in a clockwise direction relative to a face for simultaneously indicating both an hour element and a minute element of a time, a plurality of hour indicia representing hours fixedly disposed on, and spanning a 360 degree angle on, said face, a counterclockwise rotational minute panel comprising a plurality of minute indicia representing minutes of a single hour disposed thereon, and spanning a 360 degree angle thereon, said counterclockwise rotational minute panel being rotatable in a counterclockwise direction relative to said face while said single indicator is rotatable in said clockwise direction relative to said face, said counterclockwise rotational minute panel being disposed concentrically adjacent said face where said hour indicia are disposed, and wherein said single indicator is structured to simultaneously indicate the hour element based upon a location of said single indicator relative to said plurality of indicia representing hours and the minute element based upon said location of said single indicator relative to said rotational minute panel and said plurality of indicia disposed thereon.

2. The timepiece as recited in claim 1 wherein said plurality of minute indicia disposed on said counterclockwise rotational minute panel comprise a plurality of numerical indicia disposed in a clockwise ascending order.

3. The timepiece as recited in claim 1 wherein said counterclockwise rotational minute panel is disposed immediately internally adjacent said face where said hour indicia are disposed.

4. The timepiece as recited in claim 3 wherein said single indicator comprises a minute indicator portion disposed along a length thereof, said minute indicator portion of said single indicator being structured to indicate the minute element of the time based upon a position of said minute indicator portion relative to at least one of said plurality of minute indicia disposed on said rotational minute panel, and wherein an outer distal end of said single indicator is structured to indicate the hour element the time.

5. The timepiece as recited in claim 4 wherein said minute indicator portion of said single indicator is aligned with said counterclockwise rotational minute panel to identify at least one of said plurality of minute indicia disposed on said rotational minute panel to indicate the minute element of the time.

6. The timepiece as recited in claim 5 wherein said minute indicator portion comprises a display window aligned with said counterclockwise rotational minute panel to display at least one of said plurality of indicia disposed on said counterclockwise rotational minute panel there through.

7. The timepiece as recited in claim 5 wherein said counterclockwise rotational minute panel rotates less than one complete revolution per hour.

8. The timepiece as recited in claim 7 wherein said counterclockwise rotational minute panel rotates 11/12ths of a complete revolution per hour.

9. The timepiece as recited in claim 7 wherein said counterclockwise rotational minute panel rotates 23/24ths of a complete revolution per hour.

10. A timepiece, comprising:

a time indicator rotationally movable relative to a face for simultaneously indicating both an hour element and a minute element of a time, said time indicator comprising an outer distal end for identifying the hour element of the time and a minute identifying portion disposed along a length of said time indicator between said outer distal end and an inner proximal end thereof, and a minute disc disposed concentrically adjacent a portion of said face comprising a plurality of hour indicia, said minute disc being movably disposed in a counterclockwise rotational manner relative to said face while said time indicator is rotatable in a clockwise direction relative to said face, said minute disc comprising a plurality of minute indicia representing minutes of a single hour radially disposed thereon and spanning an entire rotational surface thereof, wherein said minute identifying portion of said time indicator is structured to indicate the minute element of the time based upon a relative position of said minute identifying portion and said plurality of minute indicia of said minute disc.

11. The timepiece as recited in claim 10 wherein said plurality of minute indicia disposed on said minute disc comprise numerical indicia disposed in a clockwise ascending order.

12. The timepiece as recited in claim 11 wherein said minute disc rotates less than one complete revolution per hour.

13. The timepiece as recited in claim 12 wherein said minute disc rotates relative to said face at a rate of 11/12ths of a complete revolution per hour.

14. The timepiece as recited in claim 13 wherein said time indicator rotates relative to said face at a rate of approximately 30 degrees per hour.

15. The timepiece as recited in claim 12 wherein said minute disc rotates relative to said face at a rate of 23/24ths of a complete revolution per hour.

16. The timepiece as recited in claim 15 wherein said time indicator rotates relative to said face at a rate of approximately 15 degrees per hour.

17. The timepiece as recited in claim 10 wherein said minute indicator portion of said time indicator comprises a display window aligned with said minute disc to display at least one of said plurality of indicia disposed on said minute disc there through.

* * * * *